US005156266A

United States Patent [19]

Sykora

[11] Patent Number: 5,156,266

[45] Date of Patent: Oct. 20, 1992

[54] FOLDABLE CONTAINER BLANK

[75] Inventor: John M. Sykora, Palos Hills, Ill.

[73] Assignee: Field Container Corporation, Elk Grove Village, Ill.

[21] Appl. No.: 491,051

[22] Filed: Mar. 9, 1990

[51] Int. Cl.[5] ..... B65D 77/00

[52] U.S. Cl. ..... 206/216; 206/45.28; 206/45.29; 206/49.31; 206/5; 229/162

[58] Field of Search ..... 206/44 R, 44.11, 44.12, 206/45.13, 45.29, 45.28, 45.31, 216, 223, 457, 601, 634, 5; 229/103, 162, 16 D

[56] References Cited

U.S. PATENT DOCUMENTS

| | | | |
|---|---|---|---|
| 1,616,708 | 2/1927 | Tanner | 206/44.11 |
| 1,915,341 | 6/1933 | Walker et al. | 206/44.12 |
| 2,085,414 | 6/1937 | Cavanagh | 206/45.31 |
| 2,108,278 | 2/1938 | Webber | 206/44.11 |
| 2,152,079 | 3/1939 | Mott | 206/45.12 |
| 2,200,818 | 5/1940 | Bergstein | 206/45.29 |
| 2,714,448 | 8/1955 | Brown | 206/5 |
| 2,914,236 | 11/1959 | Shapiro | 206/44 R |
| 3,038,650 | 6/1962 | Asman | 229/162 |
| 3,116,829 | 1/1964 | Pacelli | 206/5 |
| 3,167,179 | 1/1965 | Goldstein | 206/44 R |
| 3,176,899 | 4/1965 | McMahon | 229/162 |
| 3,337,032 | 8/1967 | Ebelhardt | 206/44 R |
| 4,139,121 | 2/1979 | Roccaforte | 206/45.31 |
| 4,441,614 | 4/1984 | Galliver | 206/45.31 |
| 4,648,548 | 3/1987 | Shin | 229/103 |

*Primary Examiner*—David T. Fidei
*Attorney, Agent, or Firm*—Irwin C. Alter

[57] ABSTRACT

A foldable, flat sheet is assemblable into a container by folding and sealing together of peripheral tab portions of the sheet. By this invention, at least one of the peripheral tab portions defines a central portion having aperture means proportioned to permit viewing through the aperture means with both eyes when the central portion is placed close to a normal human face. A colored, transparent sheet is sealed to the central portion covering the aperture means. The one peripheral tab portion also defines a pair of lateral portions of the foldable sheet which are attached to opposed sides of the central portion. The lateral portions comprise temple bar means of a pair of dark glasses, which dark glasses are defined by central and lateral portions upon their separation from the rest of the flat sheet.

7 Claims, 2 Drawing Sheets

FOLDABLE CONTAINER BLANK

BACKGROUND OF THE INVENTION

Foldable container blanks are normally used to manufacture cardboard boxes by assembly through folding and sealing of peripheral tab portions.

For many products, it is desired to include a prize or premium of one kind or another, particularly in products which attract children such as ice cream bars, sherbet or ice sticks, cereals, or other foods or inexpensive toys. Typically, profit margins are always under pressure, so that there is a continuing need to provide premiums to attract the purchaser at an absolute minimum cost.

By this invention, a premium can be added to a product by building it into the box in which the product for sale is provided. This can be accomplished at a cost which is little greater than the normal cost of manufacturing the box without the improvement of this invention.

Accordingly, products can be merchandised with an attractive premium, without a significant increase in the overall cost of the product and its packaging, for improved profit margins and an attractive product.

DESCRIPTION OF THE INVENTION

In this invention, a container blank is provided as a foldable, flat sheet which is assemblable into a container by folding and sealing together of peripheral tab portions of the sheet.

By this invention, such a conventional container blank is improved in that the container blank defines a portion having aperture means which is sized to permit viewing therethrough with both eyes when the central portion is placed close to a normal human face. A colored, transparent sheet is sealed to the portion, covering the aperture means.

A pair of lateral portions of the same tab portion are attached to opposed sides of the portion that carries the aperture, with the lateral portions comprising temple bar means of a pair of dark glasses, which pair of dark glasses is thus defined by the aperture-carrying and lateral portions upon their separation from the rest of the container blank. This separation may be accomplished by appropriate tear lines, by which the dark glasses portion may be torn away from the rest of the flat sheet and used by the purchaser of the product.

While the dark glasses portion may be positioned anywhere, preferably, at least one of the peripheral tab portions defines a central, aperture-carrying portion having the aperture means and the sealed, colored, transparent sheet, as well as the pair of lateral portions attached to opposed sides of the central portion. Hence, some of the edges of the dark glasses member which may be formed by its removal from the foldable, flat sheet do not have to be torn, since they can reside on the periphery of the flat sheet.

Preferably, the lateral portions which are attached to opposed sides of the central portion are so attached through fold lines. Thus, the lateral portions may serve as temple bars for the dark glasses to hold the central portion on the bridge of the nose, while the temple bars go behind the ears in the usual manner of a pair of glasses, after the lateral portions and central portion have been separated from the rest of the foldable sheet.

The lateral portions and central portion, which are typically placed on the one peripheral tab portion, are connected to the remainder of the tab portion and thus to the flat sheet through tear lines as described above, to permit separation therefrom.

It is preferable for the aperture means in the central portion to be a single aperture which is defined by two spaced eye aperture portions connected by a relatively narrow neck portion. Alternatively, two separate eye aperture portions may be used.

When the flat sheet of this invention is folded into a box by folding and sealing together of the peripheral tab portions, the one peripheral tab portion which preferably defines the central and lateral portions of the dark glasses is typically sealed to other tab portions at areas spaced from the lateral and central portions, to form part of the box wall. It is also preferred in this circumstance for the lateral portions, which form the glasses temple bars, to be folded under the central portion to reside within the box.

It is also preferred for the folded box to define an open space adjacent the central portion to permit viewing of the contents of the box. The entire box may then be wrapped in a transparent shrink wrap or the like so that the contents may be viewed while being safely packaged For example, brightly colored items such as frozen, edible ice sticks or the like may be presented in this manner, and right next to them the dark glasses premium is displayed.

The folding of the flat sheet may be in any conventional manner, with the usual technology of slits, fold lines and tear lines being imposed on the flat sheet by conventional equipment for that purpose. The flat sheet ma then be filled with product and assembled by automated machinery which folds and seals the tabs into the final, finished product in which the flat sheet forms a box surrounding the product and displaying the dark glasses portion of this invention.

DESCRIPTION OF SPECIFIC EMBODIMENT

Figure 3:
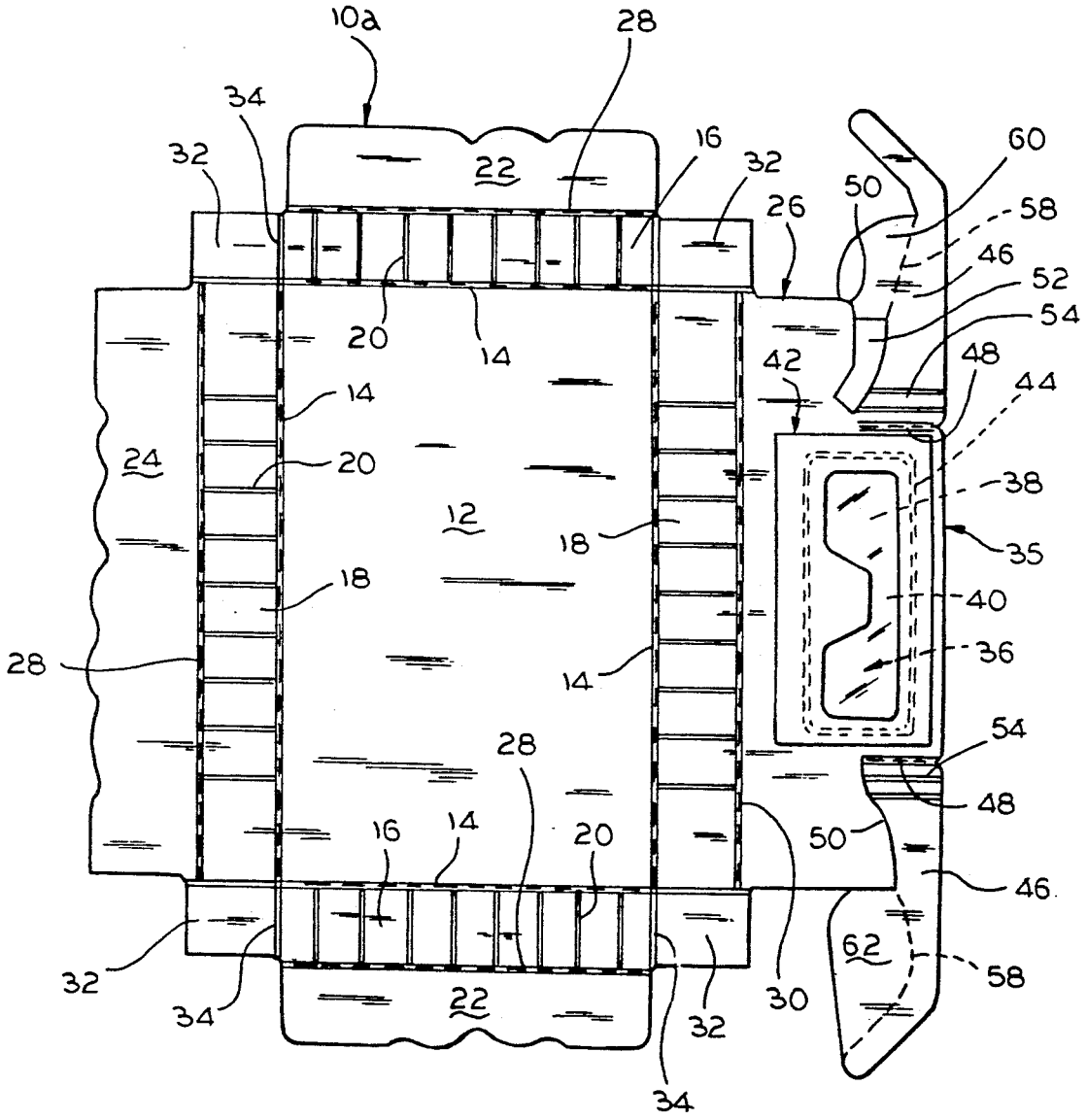
FIG. 3 is a plan view of the foldable, flat sheet used to manufacture the box of FIG. 1.

Referring to the drawings, a folded, rectangular carton or box 10 is made by folding the flat cardboard blank 10*a* which is shown in FIG. 3 and is manufactured by appropriate cutting, scoring and forming of tear lines, using conventional machinery operating on a standard piece of cardboard.

The bottom wall of container 10 is formed by central panel 12 of cardboard blank 10*a*. Rectangular bottom panel 12 is surrounded by fold lines 14 to provide four foldable side tabs, namely end-positioned side tabs 16 and side-positioned side tabs 18, which may be folded upwardly to define the side walls of container 10. Side tabs 16, 18 may define lateral ridges 20, imposed by a profiled roller or the like, for strengthening of the respective side tabs.

Figure 1:
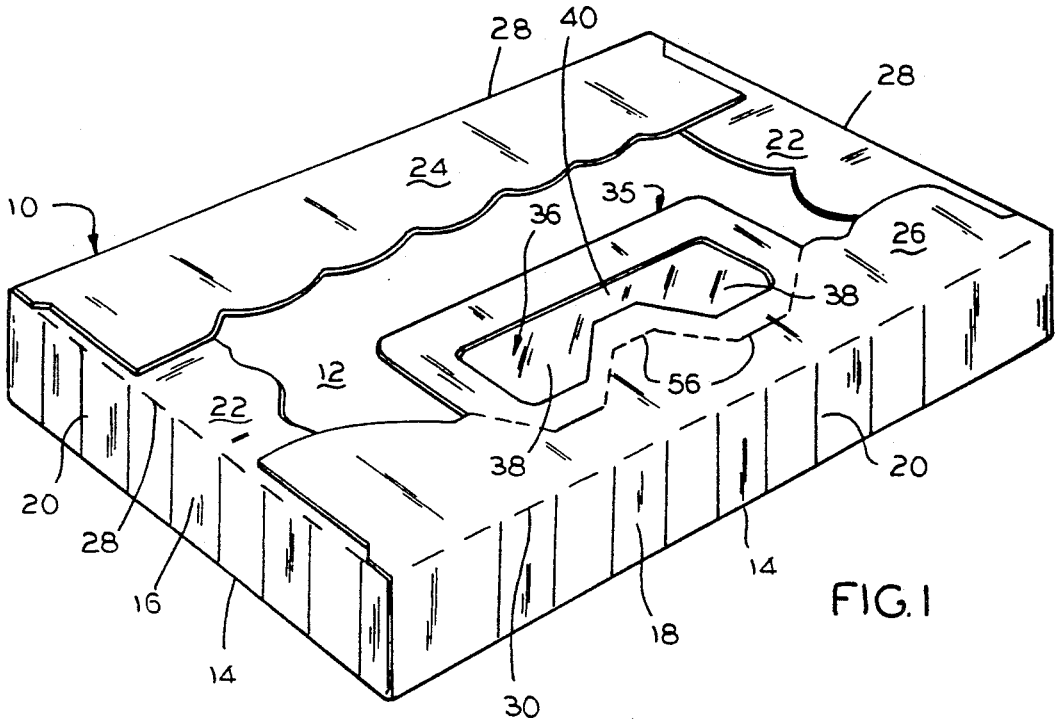
FIG. 1 is a perspective view of a folded box made of one embodiment of the foldable, flat sheet of this invention.

Four peripheral tabs are provided, including an opposed pair of peripheral end tabs 22, and a pair of opposed, peripheral side tabs 24, 26. These tabs may be respectively folded on fold lines 28, 30 so that the respective, peripheral tab portions 22, 24, 26 can be folded over into relationship parallel to central or bottom panel 12, to define the top of box 10, as shown in FIG. 1. Peripheral tabs 24, 26 may overlie end tabs 22, and may be glued with spot seals together to complete the assembly of box 10 out of flat cardboard blank or flat sheet 10*a*.

Corner tabs 32 are carried by peripheral end tabs 22, being attached by fold lines 34, to rest against the respective side walls 18 and, if desired, to be sealed thereto for additional strengthening of box 10.

In accordance with this invention, peripheral tab portion 26 includes a central portion 35 which defines an aperture 36. It can be seen that aperture 36 is a single aperture which is defined by two spaced eye aperture portions 38, connected by a relatively narrow neck portion 40. By this invention, aperture 36 is proportioned to permit viewing through the aperture with both eyes when central portion 35 is placed close to a normal human face. The length of aperture 36 may be about four inches or so, sufficient to allow both eyes to see through the aperture when placed up close to the face, one eye looking through each of the larger eye portions 38.

If desired, a piece of transparent, colored sheeting 42 is attached by adhesive line 44 (FIG. 3) to central portion 35 of tab 26, so as to entirely cover aperture 36. The color of the transparent sheeting selected depends upon the desired color of the dark glasses to be provided by this invention, typically dark blue, yellow or brown, but for novelty glasses, any desired color may be used. Otherwise, the aperture 36 may be left open.

Also, peripheral tab portion 26 may define a pair of lateral portions 46 which are connected to central portion 35 by a fold line 48 in each case, and which are generally separated by slit lines 50 and spaces 52 from the rest of the tab 26. Lateral portions 46 can thus fold horizontally about central portion 35, as shown most clearly in FIG. 2, to serve as a pair of temple bars for a pair of dark glasses which is defined by central portion 35 and lateral portions 46, collectively. Ribs 54 may be embossed into temple bars 46 adjacent to fold lines 48 to provide increased strength, with flexibility, in that section of the temple bars.

If desired, a tear line 56 may be provided along the bottom of central portion 35 to facilitate the separation of the dark glasses from the remainder of tab 26, after the container has been opened.

Also, tear lines 58 may be provided on the lateral portions 46 that serve as the temple bars to permit removal of extraneous materials 60, 62 which were not cut away during the original manufacture of container blank 10*a*, if that is desired.

Figure 2:
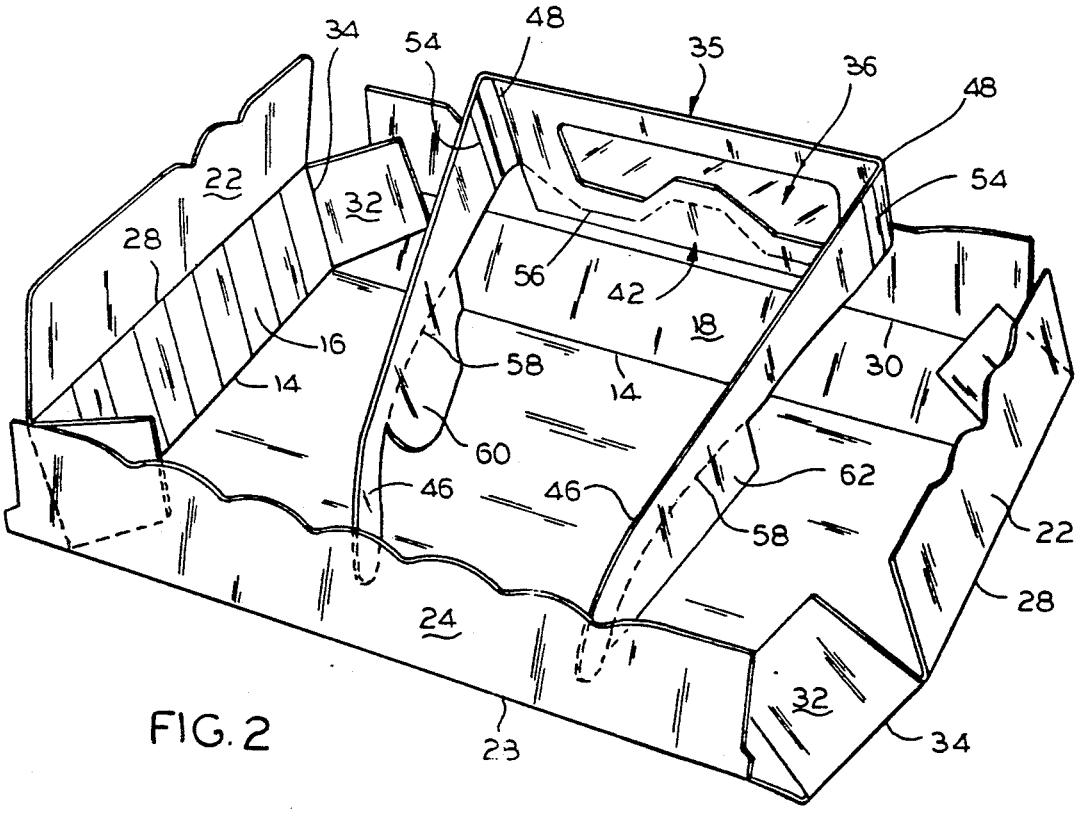
FIG. 2 is a perspective view of the flat sheet shown in FIG. 1, but in only partially folded condition in which the box is only partially formed.

FIG. 2 shows the folding of container blank 10*a* along the respective fold lines 14, 28, 30, etc. to convert the flat blank 10*a* to the folded container 10. In this process, as shown, it is preferred to fold temple bars 46 around behind the central portion 35, so that the temple bars or lateral portions 46 are folded under central portion 35 to reside within the finished box 10. As shown in FIG. 1, box 10 is empty, and an aperture is provided so that bottom panel 12 can be seen. Typically, the box 10 will be filled with product, and then will be covered with a transparent plastic wrap or the like, so that both the dark glasses premium and the product being sold, are displayed.

Thus, the container of this invention and its flat blank provide a desirable premium, such as dark glasses, which can be separated by the user and worn. Nevertheless, the cost of manufacture of such dark glasses as a part of the container is only marginally greater than the cost of manufacture of the container itself without such dark glasses.

If desired, tear line 56 can be omitted either wholly or in part, and the user can cut the dark glasses away from the rest of the container with scissors or by tearing, if that is deemed preferable.

The above has been offered for illustrative purposes only, and it is not intended to limit the scope of the invention on this application, which is as defined by the claims below.

That which is claimed is:

1. In a folded box which is made from a foldable, flat sheet assembled into a container by folding and sealing together of peripheral tab portions of the foldable, flat sheet, the improvement comprising, in combination:

at least one of said peripheral tab portions defining a central portion having aperture means proportioned to permit viewing through the aperture means with both eyes when the central portion is placed close to a normal human face; a colored, transparent sheet sealed to said central portion covering said aperture means, said one peripheral tab portion also defining a pair of lateral portions of said foldable sheet attached to opposed sides of the central portion, said lateral portions comprising temple bar means of a pair of dark glasses which is defined by the central and lateral portions upon their separation from the rest of the flat sheet, said one peripheral tab portion being sealed to other tab portions at areas spaced from the lateral and central portions to form part of the box wall, said lateral portions being folded under said central portion to reside within said box.

2. The foldable, flat sheet of claim 1 in which the aperture means is a single aperture defined by two spaced eye aperture portions connected by a relatively narrow neck portion.

3. The foldable, flat sheet of claim 2 in which the lateral portions and central portion of the one peripheral tab portion are connected to the remainder of said flat sheet through tear lines to permit separation therefrom.

4. The box of claim 2 which is made of cardboard.

5. In a foldable, flat sheet which is assembled into a container by folding and sealing together of peripheral tab portions o the sheet, the improvement comprising, in combination:

said flat sheet defining a central portion having aperture means proportioned to permit viewing through the aperture means with both eyes when the central portion is placed close to a normal human face; a colored, transparent sheet sealed to said central potion covering said aperture means, said flat sheet also defining a pair of lateral portions as attached to opposed sides of said central portion, said lateral portions comprising temple bar means of a pair of dark glasses which is defined by the central and lateral portions upon their separation from the rest of the flat sheet, and said lateral portions being folded under said central portion to reside within said container.

6. In a foldable flat sheet which is assembled into a container by folding and sealing together of peripheral tab portions of the sheet 6, the improvement comprising, in combination:

at least one of said peripheral tab portions defining a central potion having aperture means proportioned to permit viewing through the aperture means with both eyes when the central potion is placed close to a normal human face; said sheet slabs defining a pair of lateral portions of said foldable sheet attached to opposed sides of the central portion, said lateral portions comprising temple bar means of a pair of dark glasses which is defined by the central and lateral portions upon their separation from the rest of the flat sheet, said one peripheral tab portion being sealed to the other tab portions at areas spaced from said lateral and central portions to form part of said box wall, and said lateral portions being folded under said central portion to reside within said box.

7. The folded box of claim 6 which defines an open space to permit viewing of the contents thereof.

* * * * *